US010158153B2

(12) United States Patent
Guyette et al.

(10) Patent No.: US 10,158,153 B2
(45) Date of Patent: Dec. 18, 2018

(54) BANDSTOP FILTERS WITH MINIMUM THROUGH-LINE LENGTH

(71) Applicant: The United States of America, as represented by the Secretary of the Navy, Washington, DC (US)

(72) Inventors: Andrew C. Guyette, San Mateo, CA (US); Eric J. Naglich, Alexandria, VA (US)

(73) Assignee: The United States of America, as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 15/859,691

(22) Filed: Jan. 1, 2018

(65) Prior Publication Data

US 2018/0175472 A1 Jun. 21, 2018

Related U.S. Application Data

(63) Continuation-in-part of application No. 15/073,292, filed on Mar. 17, 2016, now Pat. No. 9,859,599.

(60) Provisional application No. 62/309,191, filed on Mar. 16, 2016, provisional application No. 62/134,457, filed on Mar. 17, 2015.

(51) Int. Cl.
*H01P 1/203* (2006.01)

(52) U.S. Cl.
CPC ..... *H01P 1/2039* (2013.01)

(58) Field of Classification Search
CPC ..... H01P 1/203; H01P 1/2039; H01P 1/184; H01P 1/227
USPC ..... 333/204
See application file for complete search history.

(56) References Cited

U.S. PATENT DOCUMENTS 5,896,073 A * 4/1999 Miyazaki ..... H01P 1/2056 333/204
6,127,905 A * 10/2000 Horie ..... H01P 1/20345 333/185
9,859,599 B2 1/2018 Guyette et al.
2008/0100401 A1 5/2008 Cho
2010/0117766 A1 5/2010 Grondahl

OTHER PUBLICATIONS

Nizam et al., "Design of a Modified L-Shaped Bandstop Filter for UWB Applications," 2009 SBMO/IEEE MTT-S International Microwave and Optoelectronics Conference (IMOC), pp. 177-182.

* cited by examiner

*Primary Examiner* — Benny Lee
*Assistant Examiner* — Hafizur Rahman
(74) *Attorney, Agent, or Firm* — US Naval Research Laboratory; William P. Ladd

(57) ABSTRACT

Systems and methods are provided for creating higher order microwave bandstop filters with total through-line length of significantly less than one-quarter wavelength at the filter center frequency. The mixed electric and magnetic field coupling bandstop filter topologies provided by embodiments of the present disclosure can be used to reduce the size, weight, and throughline insertion loss of microwave bandstop filters. In an embodiment, if the relative field strengths are intelligently designed for each coupling structure, effective phase offsets can be produced between resonators along the through line. These phase offsets can be used to absorb some or all of the length of the λ/4 inverters between resonators.

19 Claims, 19 Drawing Sheets

BANDSTOP FILTERS WITH MINIMUM THROUGH-LINE LENGTH

CROSS REFERENCE TO RELATED APPLICATIONS

This application is a continuation-in-part of U.S. patent application Ser. No. 15/073,292, filed on Mar. 17, 2016, to be assigned U.S. Pat. No. 9,859,599, which claims the benefit of U.S. Provisional Patent Application No. 62/134,457, filed on Mar. 17, 2015, and U.S. Provisional Patent Application No. 62/309,191, filed on Mar. 16, 2016, all of which are incorporated by reference herein their entireties.

FIELD OF THE DISCLOSURE

This disclosure relates to filters, including bandpass filters.

BACKGROUND

Microwave bandstop filters can be used to reflect or absorb unwanted signals in a microwave system. These unwanted signals can originate from co-site or externally generated interference as well as nonlinear components under high-power excitation in the system. For example, a traditional microwave bandstop filter can be composed of resonators coupled to a through line with quarter-wavelength admittance inverters between each resonator. This bandstop filter topology can produce a symmetric notch frequency response and meet a wide variety of practical specifications. However, when the traditional microwave bandstop filter topology is used for high-order filters, the total through-line length becomes long.

A long through-line leads to higher passband insertion loss, increased circuit size and weight, and larger dispersive effects. In addition, the through-line lengths are difficult to tune in production environments yet have appreciable effects on the frequency response of the filter. Thus, conventional bandpass filters have undesirably large passband insertion loss, size, and weight.

BRIEF DESCRIPTION OF THE DRAWINGS/FIGURES

The accompanying drawings, which are incorporated in and constitute part of the specification, illustrate embodiments of the disclosure and, together with the general description given above and the detailed descriptions of embodiments given below, serve to explain the principles of the present disclosure. In the drawings.

Figure 12:
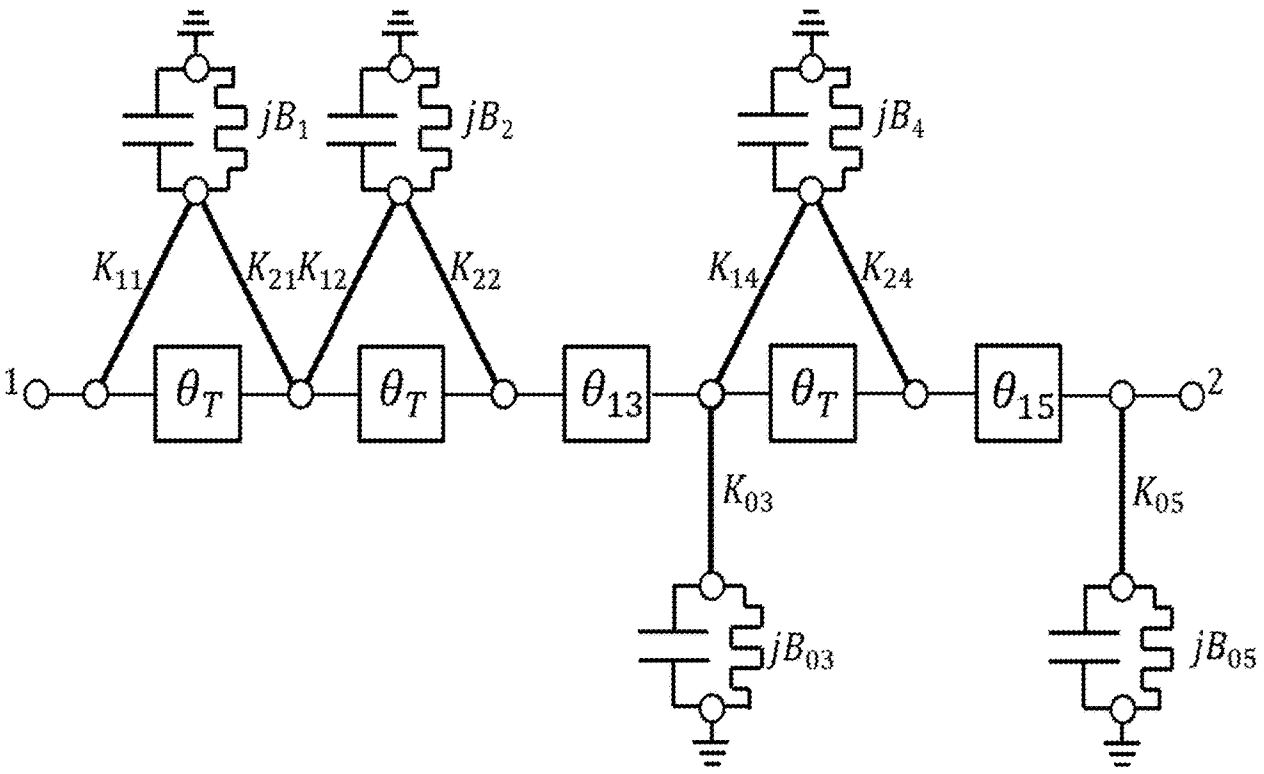
Figure 13:
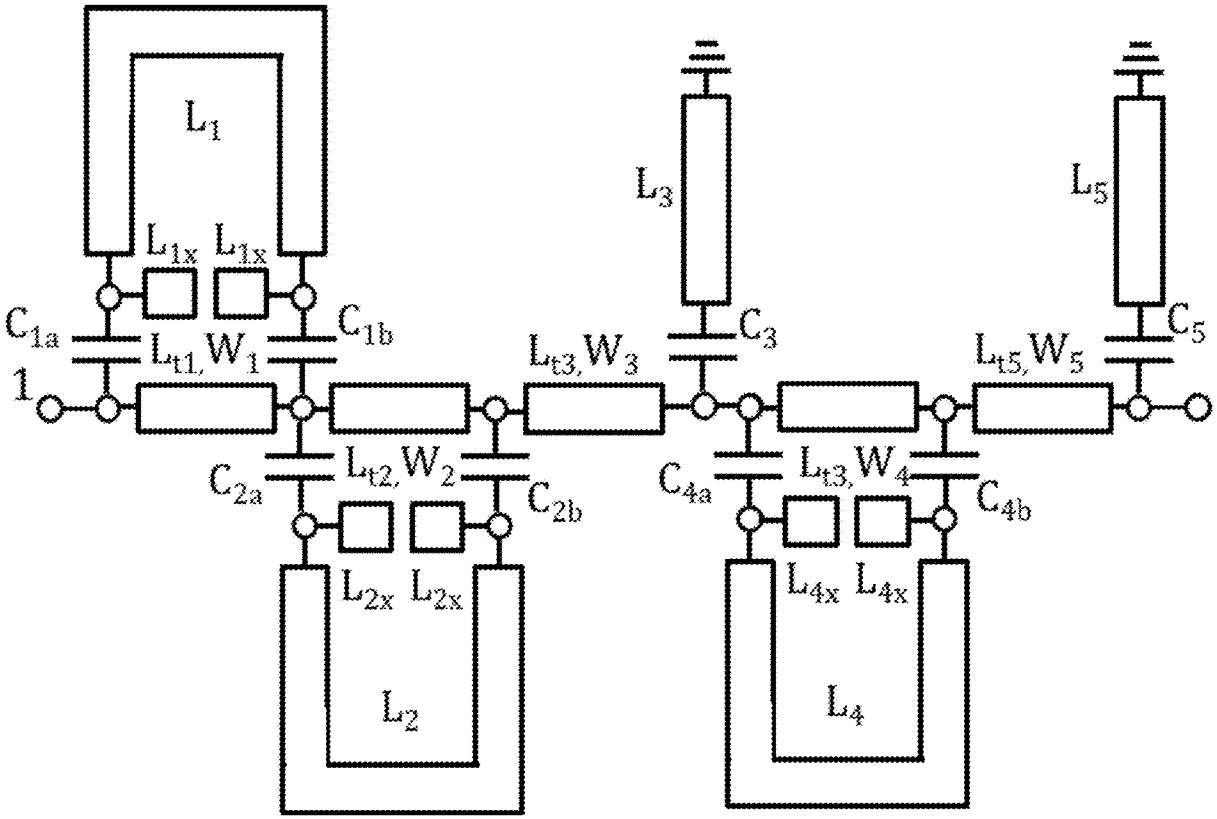

FIG. 12 is a diagram showing an exemplary implementation of the 5th-order elliptic bandstop filter using 1st-order dual-coupled-resonator bandstop sections with 14.32° through-lines and single-coupled-resonator sections in accordance with an embodiment of the present disclosure; and FIG. 13 is a diagram showing a schematic of the $5^{th}$-order elliptic prototype using dual-coupled resonators and single-coupled resonators in accordance with an embodiment of the present disclosure.

Features and advantages of the present disclosure will become more apparent from the detailed description set forth below when taken in conjunction with the drawings, in which like reference characters identify corresponding elements throughout. In the drawings, like reference numbers generally indicate identical, functionally similar, and/or structurally similar elements. The drawing in which an element first appears is indicated by the leftmost digit(s) in the corresponding reference number.

DETAILED DESCRIPTION

In the following description, numerous specific details are set forth to provide a thorough understanding of the disclosure. However, it will be apparent to those skilled in the art that the disclosure, including structures, systems, and methods, may be practiced without these specific details. The description and representation herein are the common means used by those experienced or skilled in the art to most effectively convey the substance of their work to others skilled in the art. In other instances, well-known methods, procedures, components, and circuitry have not been described in detail to avoid unnecessarily obscuring aspects of the disclosure.

References in the specification to "one embodiment," "an embodiment," "an exemplary embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

For purposes of this discussion, the term "module" shall be understood to include one of software, or firmware, or hardware (such as circuits, microchips, processors, or devices, or any combination thereof), or any combination thereof. In addition, it will be understood that each module can include one, or more than one, component within an actual device, and each component that forms a part of the described module can function either cooperatively or independently of any other component forming a part of the module. Conversely, multiple modules described herein can represent a single component within an actual device. Further, components within a module can be in a single device or distributed among multiple devices in a wired or wireless manner.

1. Overview

Embodiments of the present disclosure provide systems and methods for implementing bandstop filters using minimum through-line lengths between coupled resonators. For example, conventional microwave bandstop filters with λ/4 inverters between each resonator usually assume that the coupling structures between the through-line and the resonators all implement coupling with either electric field, magnetic field, or the same relative mixture of electric and magnetic field. Embodiments of the present disclosure use mixed electric and magnetic field coupling to reduce physical length between coupled lines.

In an embodiment, a bandstop filter in accordance with an embodiment of the present disclosure comprises a number of resonators coupled along a transmission line, with a ratio of electric to magnetic coupling of each resonator set such that that physical length between coupled lines is minimized. For example, in an embodiment, if the relative field strengths are intelligently designed for each coupling structure, effective phase offsets can be produced between resonators along the through line. These phase offsets can be used to absorb some or all of the length of the λ/4 inverters between resonators. Thus, the bandstop filter topologies provided by embodiments of the present disclosure can be used to reduce the size, weight, and throughline insertion loss of microwave bandstop filters.

2. Bandstop Filters

Figure 1A:
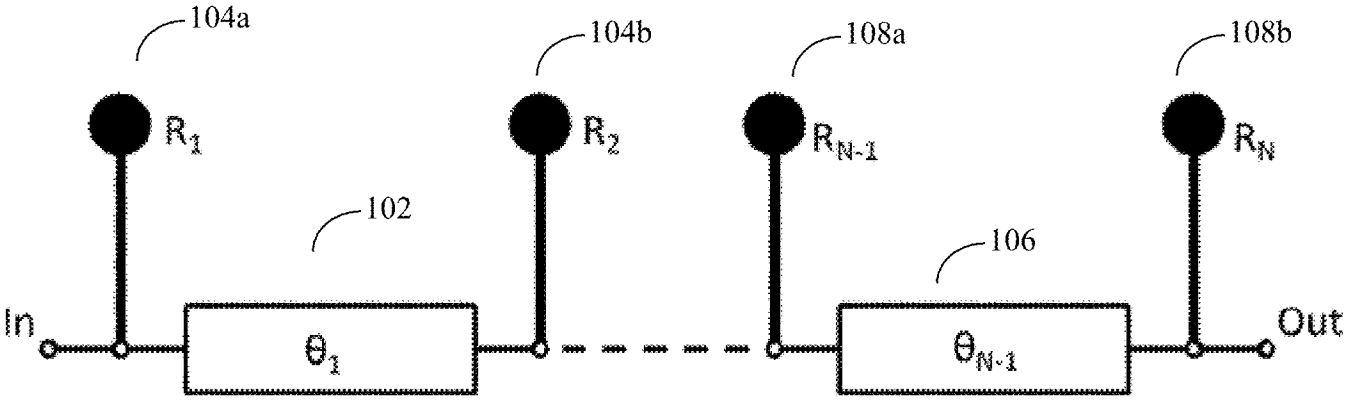
FIG. 1A is a diagram showing an exemplary in-line microwave bandstop circuit topology comprising a transmission line to which a number of electromagnetic resonators are coupled in accordance with an embodiment of the present disclosure.

Bandstop filters can be used in microwave systems to excise unwanted signals. FIG. 1A is a diagram showing an exemplary in-line microwave bandstop circuit topology comprising a transmission line 102 to which a number of electromagnetic resonators 104 are coupled. The electrical length between adjacent resonators is typically close to a quarter wavelength, defined at the center frequency of the filter. The required transmission line lengths in the circuit topology of FIG. 1A limit passband insertion loss and place a lower limit on size and weight. As shown in FIG. 1A, any number of additional bandstop filters 106 and electromagnetic resonators 108 can be coupled to the circuit.

An exemplary bandstop filter in accordance with an embodiment of the present disclosure comprises a number of resonators coupled along a transmission line, with the ratio of electric to magnetic coupling of each resonator set such that the physical length between coupled resonators is minimized. This approach can be applied to both in-line bandstop topologies as well as other topologies, including reflection-mode.

3. Reflection Mode Topology

Figure 1B:
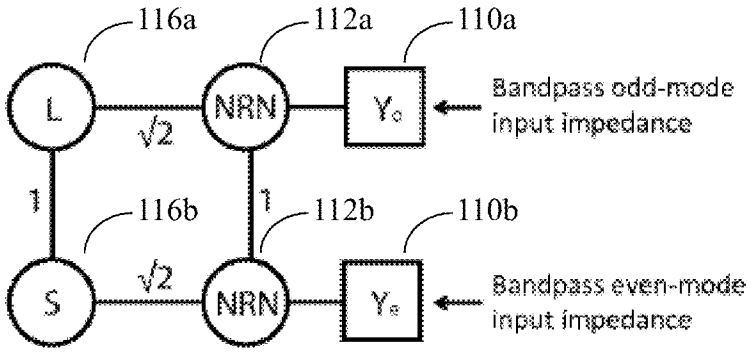
FIG. 1B is a diagram of a circuit that implement the even- and odd-mode impedances of a bandpass filter designed in accordance with an embodiment of the present disclosure.

A reflection-mode bandstop filter can be constructed by first designing a prototype bandpass filter with a reflection coefficient that is equivalent to the transmission coefficient of the desired bandstop filter. FIG. 1B is a diagram of a circuit that implements the even- and odd-mode impedances of a bandpass filter designed in accordance with an embodiment of the present disclosure. In FIG. 1B, even- and odd-mode impedances 110 are connected to two adjacent ports 112 of a four-port hybrid circuit. The remaining two ports 116 of the hybrid circuit are used as source and load ports. The combined circuit retains the even-mode impedance of the prototype bandpass filter but inverts the odd-mode impedance. When the odd-mode impedance of any linear network is inverted, the reflection coefficient becomes the transmission coefficient and vice-versa. Therefore, since the initial network was a bandpass filter, a bandstop response is produced.

A significant advantage of reflection-mode topology is that only two resonators are required to be coupled to the through-line regardless of the filter order. For example, in an exemplary fifth-order bandstop filter in accordance with an embodiment of the present disclosure, only two resonators are directly coupled to the through-line. Such a topology allows for minimum through-line length in planar technologies like stripline because a resonator can be placed on both sides of the through-line at the same point. In a fifth-order in-line topology, all five resonators would be coupled to the through line. However, even in three dimensional circuit topologies, coupling five resonators to the through-line at the same point would be difficult or impractical, resulting in a need to lengthen the through-line.

4. Bandstop Filters with Minimum Through-Line Length

A conventional microwave bandstop filter with λ/4 inverters between each resonator assumes that the coupling structures between the through-line and the resonators all implement coupling with either electric field, magnetic field, or the same relative mixture of electric and magnetic field. A bandstop filter in accordance with an embodiment of the present disclosure uses mixed electric and magnetic field coupling to reduce physical length between coupled lines. In an embodiment, if the relative field strengths are intelligently designed for each coupling structure, effective phase offsets can be produced between resonators along the through line. These phase offsets can be used to absorb some or all of the length of the λ/4 inverters between resonators. This concept is illustrated in FIG. 2A.

Figure 2A:
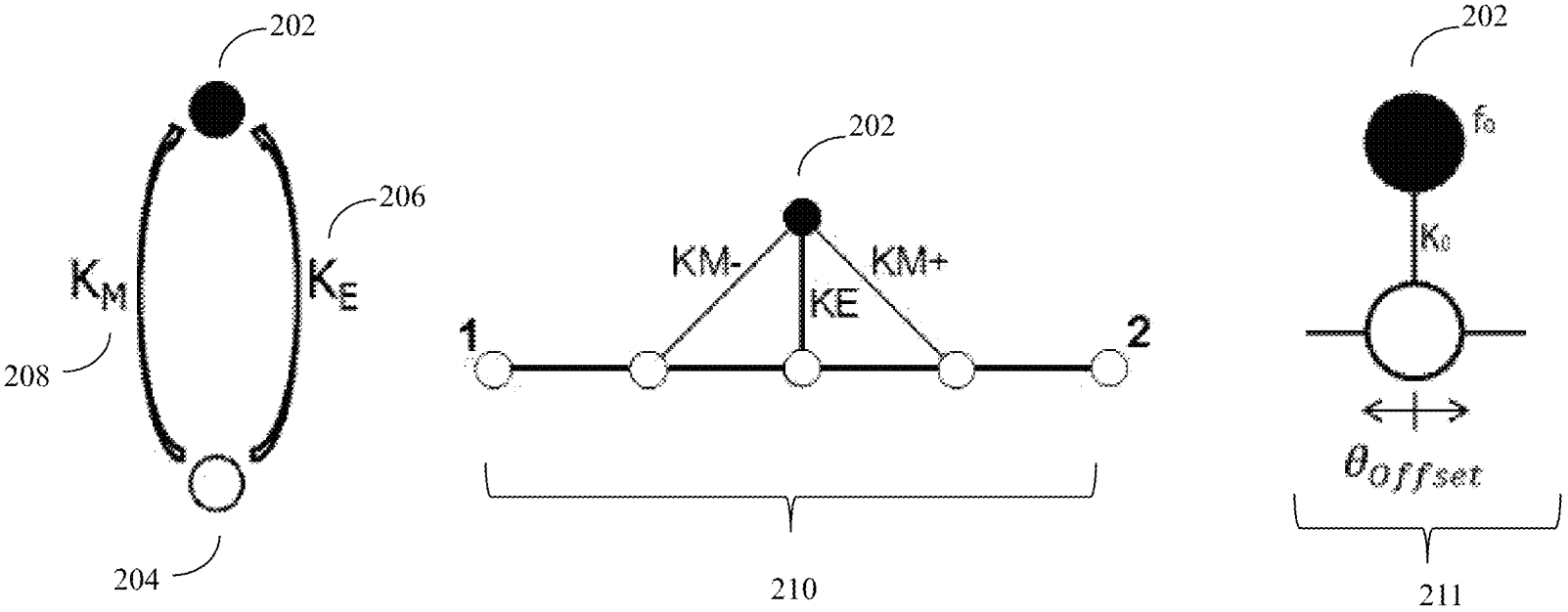
FIG. 2A is a diagram showing a resonator coupled to a node with a mixture of both electric and magnetic coupling (mixed coupling) in accordance with an embodiment of the present disclosure.

FIG. 2A is a diagram showing a resonator 202 coupled to a node 204 with a mixture of both electric 206 and magnetic 208 coupling (mixed coupling). FIG. 2A further shows that this point can be thought of as 360 degrees of electrical phase over zero physical length. FIG. 2A also shows an equivalent circuit 210 for this mixed coupling circuit based on an expansion 210 of node 204 to 360-degree phase length using 4 admittance inverters matched to the port impedance. The electric and magnetic couplings in FIG. 2A are represented by admittance inverters KE and KM+/−, respectively. The point in FIG. 2A couples to resonator 202 with negative magnetic, positive electric, and positive magnetic coupling, where negative and positive values are assigned to represent a 180 degree phase shift between two coupling values of similar type. The composite phase offset due to multiple types of coupling between a single node and a resonator can be reduced to equivalent circuit 211. Thus, equivalent circuit 211 is a representation of the node in equivalent circuit 210 as a phase offset dependent on E and M coupling. In equivalent circuit 211, $K_0=\sqrt{(K_E^2+K_M^2)}$ and $$\theta_{offset} = \pm\frac{1}{2}\mathrm{Arg}\left(\frac{2K_E}{K_E - jK_M} - 1\right),$$

where the sign of $\theta_{offset}$ depends on the relative orientation of magnetic coupling. In an embodiment, these equations can be implemented in a fourth-order minimum through length bandstop filter design, which is illustrated in FIG. 2B.

Figure 2B:
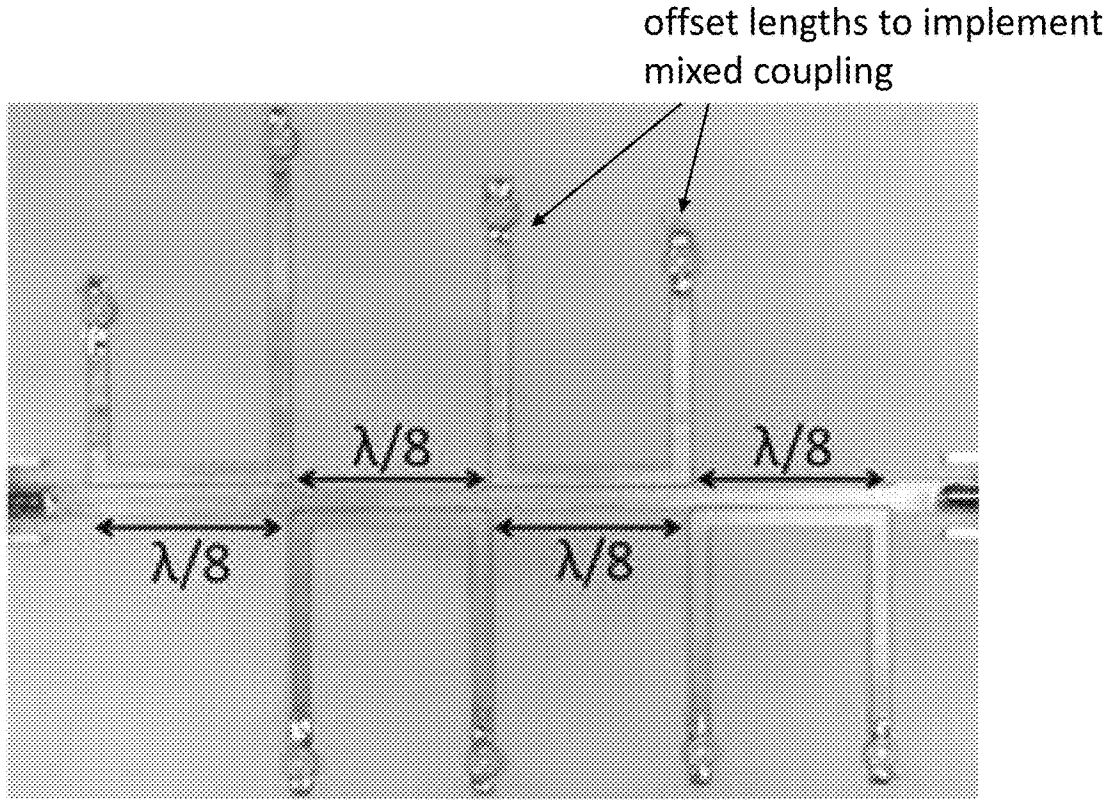
FIG. 2B is a diagram showing a photograph of an exemplary filter using mixed electric and magnetic field coupling to resonators along a through line that implements a fourth-order bandstop filter design in accordance with an embodiment of the present disclosure.

FIG. 2B is a diagram showing a photograph of an exemplary filter using mixed electric and magnetic field coupling to resonators along a through line that implements a fourth-order bandstop filter design in accordance with an embodiment of the present disclosure. In FIG. 2B, each resonator is coupled to the through line over a λ/8 physical length of line and implements a λ/8 electrical shift of the coupling reference plane between it and the next resonator through the use of appropriately designed mixed coupling. In FIG. 2B, the λ/8 physical coupling section for each resonator is followed directly by the λ/8 physical coupling section for the next resonator, so the entire length of the through line is coupled to a resonator. This is possible regardless of the length of the physical coupling section required for the desired coupling values if appropriately-designed mixed coupling is used. The result is a minimum-length design for the implemented fabrication technology and coupling values. With the combination of the λ/8 phase shifts due to the physical lengths of the coupling sections and the λ/8 electrical $\theta_{offset}$ shifts of the coupling reference planes between each pair of resonators, a composite λ/4 inverter exists between each pair of resonators despite there being only λ/8 of physical through line between each resonator.

While this technique enables an improvement over conventional designs that have a total through-line length of N*λ/4, where N is the order of the filter, the total through-line length, N*Lc, where Lc is the length of the coupling section between the through line and each resonator, can still be significant for high-order filters. The combination of reflection-mode circuit techniques and minimum-through-line-length bandstop filter theory can produce bandstop filter designs with total throughline length equal to only the length of a single coupling section, Lc, regardless of filter order. Therefore, the total through-line length becomes only a function of the desired coupling values and fabrication technology tolerances, not filter order, and it can be much shorter than λ/4 for many filter specifications. For high-order filters, dramatic reductions of total length are possible.

Figure 3:
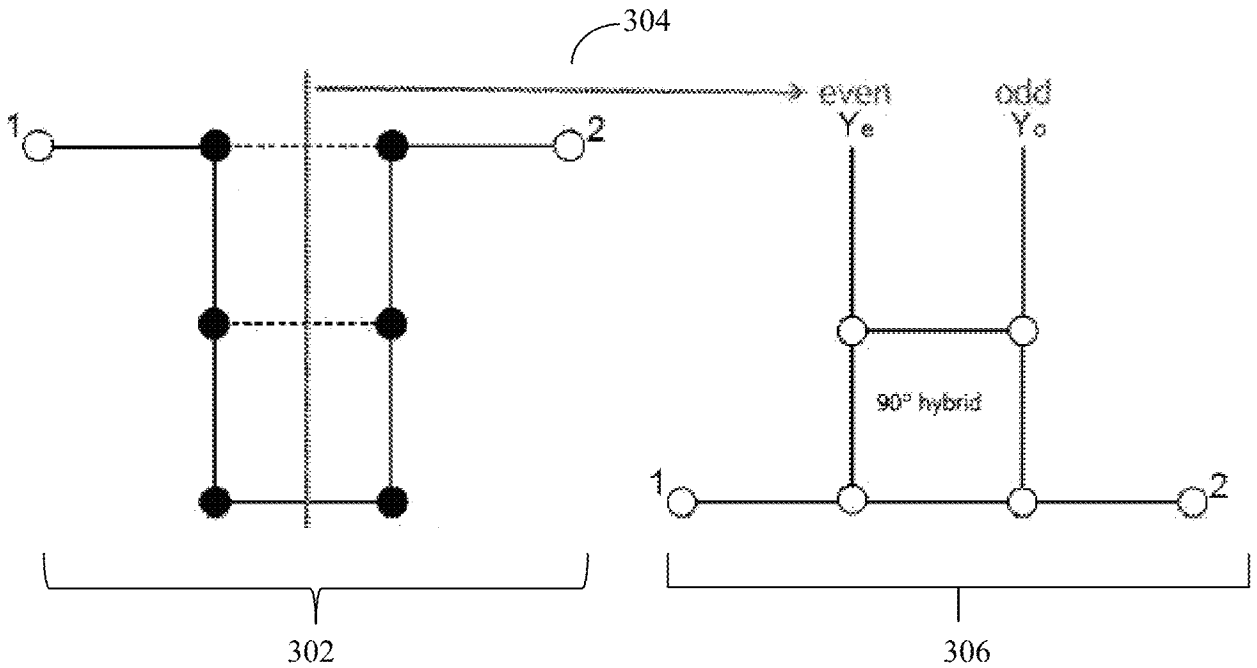
FIG. 3 is a diagram showing an example transformation of an elliptic bandpass filter to a highly selective bandstop filter in accordance with an embodiment of the present disclosure.

Reflection-mode topology can be used to interchange the reflection and transmission responses of a circuit network by placing the network's even and odd mode impedances at the correct ports of the reflection-mode structure. FIG. 3 is a diagram showing an example transformation of an elliptic bandpass filter to a highly selective bandstop filter. Elliptic bandpass filters are known for the maximum selectivity that they provide, and embodiments of the present disclosure can use that selectivity in a bandstop mode. In FIG. 3, elliptic bandpass topology 302 is transformed 304 to reflection-mode bandstop topology 306. The 90-degree hybrid in the reflection-mode bandstop topology 306 shown in FIG. 3 is classically implemented by four quarter wavelength transmission lines of varying characteristic impedance. However, when used in conjunction with an embodiment of the present disclosure, it can be reduced to a single physical point when the correct phase and strength of electromagnetic coupling values are used, as shown in FIG. 2A.

Figure 4:
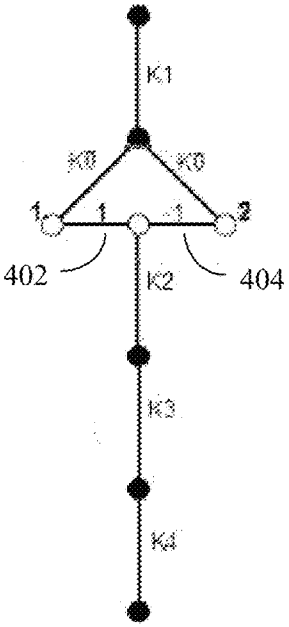
FIG. 4 is a diagram showing a zero-length, phase-expanded point that involves two couplings to one resonator and one coupling to another resonator in accordance with an embodiment of the present disclosure.

The phase-expanded but zero-length view of a point along a through line shown in FIG. 2A can be used to understand how the 90 degree hybrid in the reflection-mode bandstop prototype in accordance with an embodiment of the present disclosure collapses into a single point. FIG. 4 is a diagram showing a zero-length, phase-expanded point that involves two couplings to one resonator and one coupling to another resonator. The two couplings to the same resonator have the same phase and are of the same type because the couplings that are represented by "1" 402 and "−1" 404 in FIG. 4 are separated by 360 degrees of phase length. The coupling to the resonator below the hybrid equivalent circuit is of the opposite type because it is separated from the other two couplings by 90 and 270 degrees.

5. Second Order Example

Figure 5:
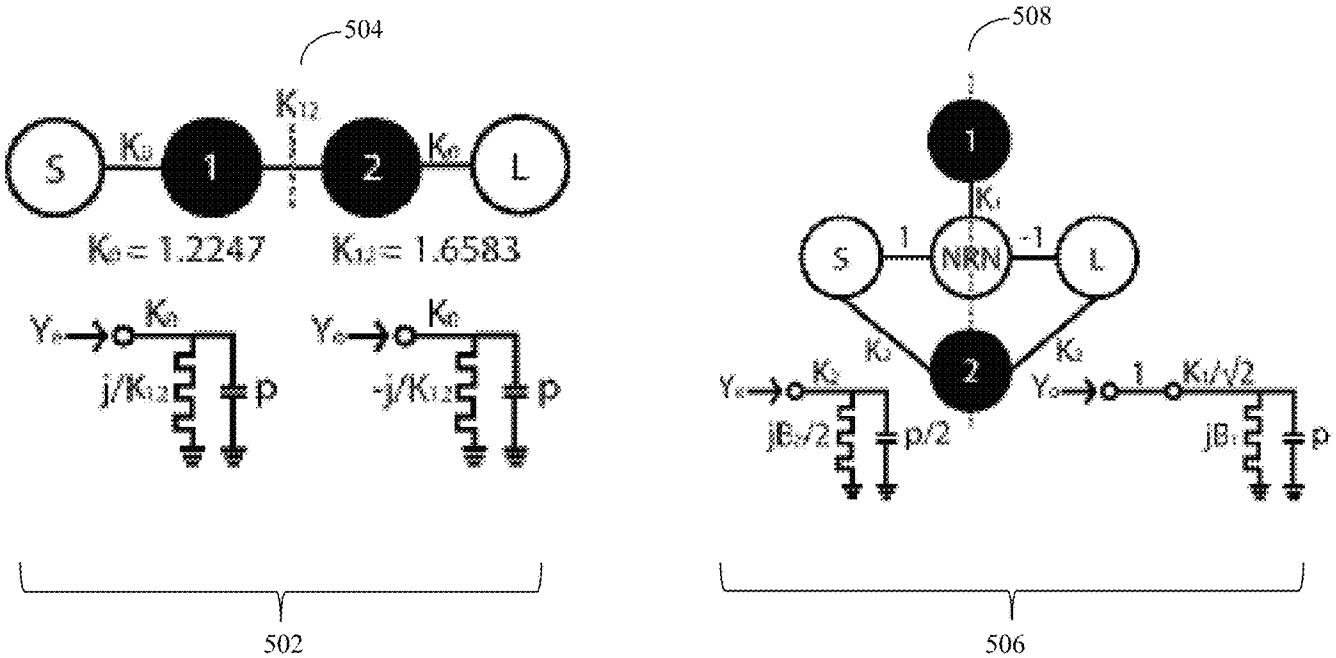
FIG. 5 is a coupling-routing diagram for a prototype lowpass filter in accordance with an embodiment of the present disclosure.

In an embodiment, the even and odd-mode admittances of a prototype lowpass filter can be determined and, the proposed reflection-mode topology can be used to implement a prototype highpass filter with a transmission coefficient equal to the reflection coefficient of the lowpass prototype and vice-versa. The highpass prototype can be transformed to produce a bandstop response using standard circuit techniques. In this example, a second-order, 20 dB equi-ripple Chebychev lowpass filter prototype will be used as the starting point. However, any lowpass prototype filter can be used for the design procedure. FIG. 5 is a coupling-routing diagram 502 for the prototype lowpass filter. The dashed line through the $K_{12}$ coupling 504 is the symmetry plane used for even-odd mode analysis, and the even- and odd-mode sub-circuits can also be seen in FIG. 5. For the even mode, the $K_{12}$ coupling becomes an open-circuited λ/8 length of line with a characteristic impedance of $K_{12}$, and the input admittance is given by $Y_e=K_0^2/(p+j/K_{12})$, where j is the square root of −1, and p is the frequency variable jω. For the odd mode, the $K_{12}$ coupling becomes a shortcircuited λ/8 length of line with a characteristic impedance of $K_{12}$, and the odd-mode input admittance is given by $Y_e=K_0^2/(p-j/K_{12})$. The reflection and transmission coefficients of the network can be found using the equations $S_{11}=(1-Y_eY_o)/((1+Y_e)(1+Y_o))$ and $S_{21}=(Y_o-Y_e)/((1+Y_e)(1+Y_o))$.

FIG. 5 also shows a 2-pole version 506 of the proposed reflection mode topology in with a dashed line 508 that indicates the plane of symmetry for even-odd mode analysis.

It is important to note that the lower path through the resonator is symmetric about the dashed line, while the upper path is antisymmetric about the dashed line due to the opposite signs of the unity-magnitude inverters. An antisymmetric path will have opposite terminations in even-odd mode analysis relative to the symmetric case. For example, analysis of the even mode will use short circuit terminations in the asymmetric path. For the even mode, the antisymmetric path is shorted to ground, and the even-mode input admittance is given by $Y_e=K_2^2/(0.5(p+jB_2))$, where $B_2$ is a frequency-invariant suseceptance that manifests as a shift of the center frequency of resonator 2. Note that the $K_2$ couplings to the source and load are in-phase due to the 360 degree phase shift between the source and load ports.

For the odd mode, the lower path through resonator 2 is shorted to ground. In an embodiment, the even mode admittances have the same form; however, the forms of the odd mode admittances are inverses of each other. Therefore, in an embodiment, the reflection-mode topology can produce a highpass response with a transmission coefficient equal to the lowpass prototype's reflection coefficient.

Comparing the input admittances for FIGS. 2B and 5, it can be seen that the even mode admittances have the same form. However, the forms of the odd mode admittances are inverses of each other. Therefore, the reflection-mode topology can produce a highpass response with a transmission coefficient equal to the lowpass reflection coefficient if $K_1$, $K_2$, $B_1$, and $B_2$ are designed properly. Solving for the desired quantities yields $B_1=1/K_{12}$, $K_1=\sqrt{2}K_0$, $B_2=-1/K_{12}$, and $K_2=K_0/\sqrt{2}$.

If this 2-pole highpass filter was translated into a physical bandstop filter design, the total through-line length could be limited to only that which is needed to obtain the desired magnitudes of $K_1$ and $K_2$ if $K_1$ and $K_2$ use the proper combination of electric and magnetic coupling such that their offset values produce an intrinsic phase shift that makes the total shift equal to an odd multiple of $\lambda/4$. Depending on the design bandwidth, manufacturing technology, and characteristic impedance values, the amount of $\lambda/4$ shift required to be obtained from a physical length of transmission line can be very small.

6. Fifth Order Example

Figure 6A:
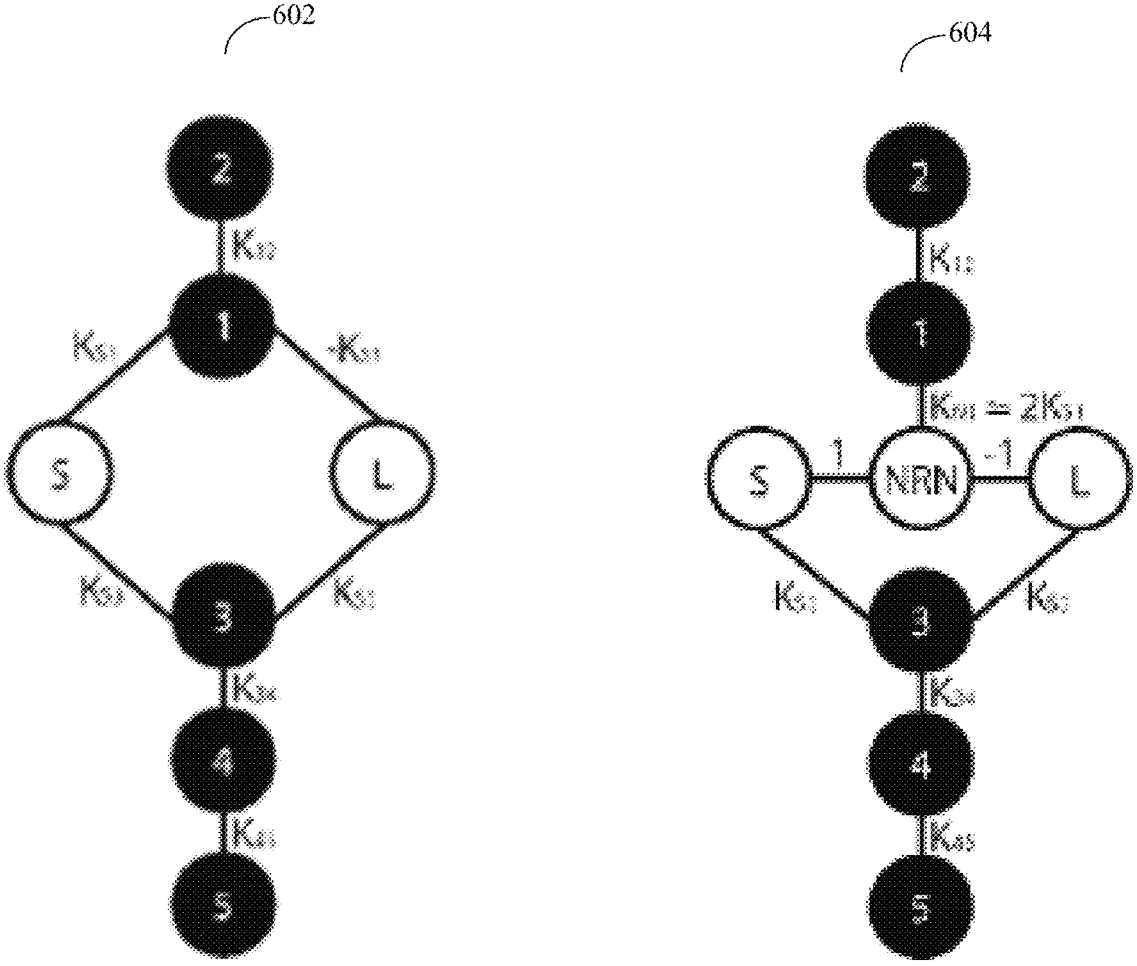
FIG. 6A is a diagram showing a coupling-routing diagram of a fifth-order bandpass filter in accordance with an embodiment of the present disclosure.

While the example shown in the previous section could reduce the total through-line length of a second-order filter to the length of one coupling section, the proposed bandstop filter concept is especially beneficial in high-order bandstop filter designs. The through-line length does not increase beyond the length needed to couple to the first two resonators of the filter as the filter order grows. Therefore, high-order bandstop filters can be made with total through-line length equal to the length of one coupling section. FIG. 6A is a diagram showing the coupling-routing diagram 602 of a fifth-order bandpass filter.

Figure 6B:
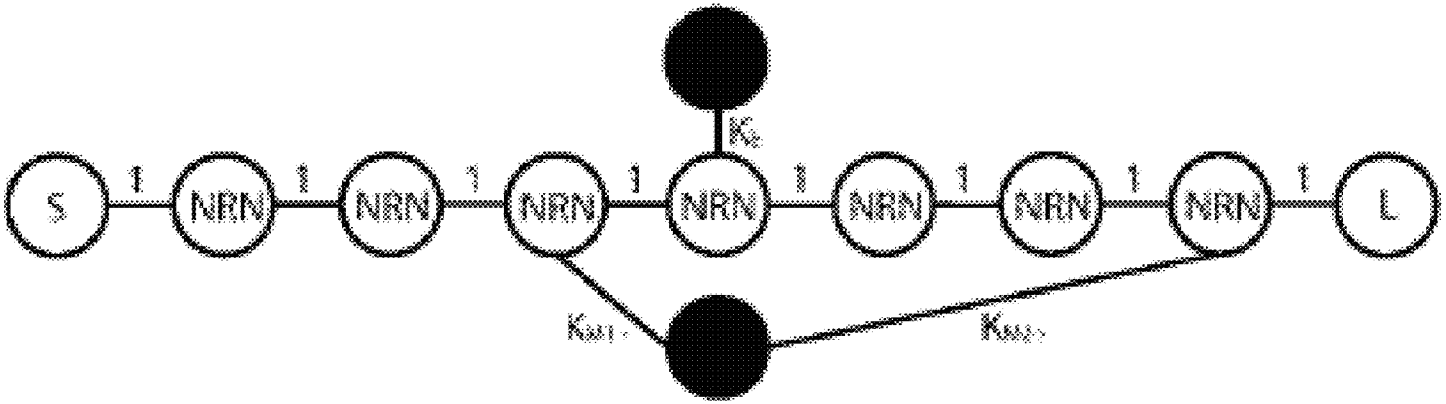
FIG. 6B is a diagram showing an exemplary expansion based on the source and load nodes of the coupling routing diagram of FIG. 6A that more clearly shows the phase relationships between the coupling values in accordance with an embodiment of the present disclosure.

Using the same even and odd-mode analysis procedure shown in the second-order example, the even- and odd-mode admittances of the fifth order bandpass filter can be found and set equal to the even and odd-mode admittances of the fifth-order reflection-mode bandstop topology 604. The result is a 30-dB equi-ripple bandstop response with four reflection zeros. This response was used as a target specification to design and fabricate a suspended-stripline prototype circuit for verification. In FIG. 6A, resonators 1 and 3 are coupled to the through line. To realize the bandstop topology in FIG. 6A with the shortest possible through line, a physical coupling topology that implements the phase differences between the required electric and magnetic coupling coefficients over minimum through-line length can be designed for the chosen resonator technology. FIG. 6B is a diagram showing an exemplary expansion based on the source and load nodes of the coupling routing diagram of FIG. 6A that more clearly shows the phase relationships between the coupling values.

7. Exemplary Implementations

Figure 7:
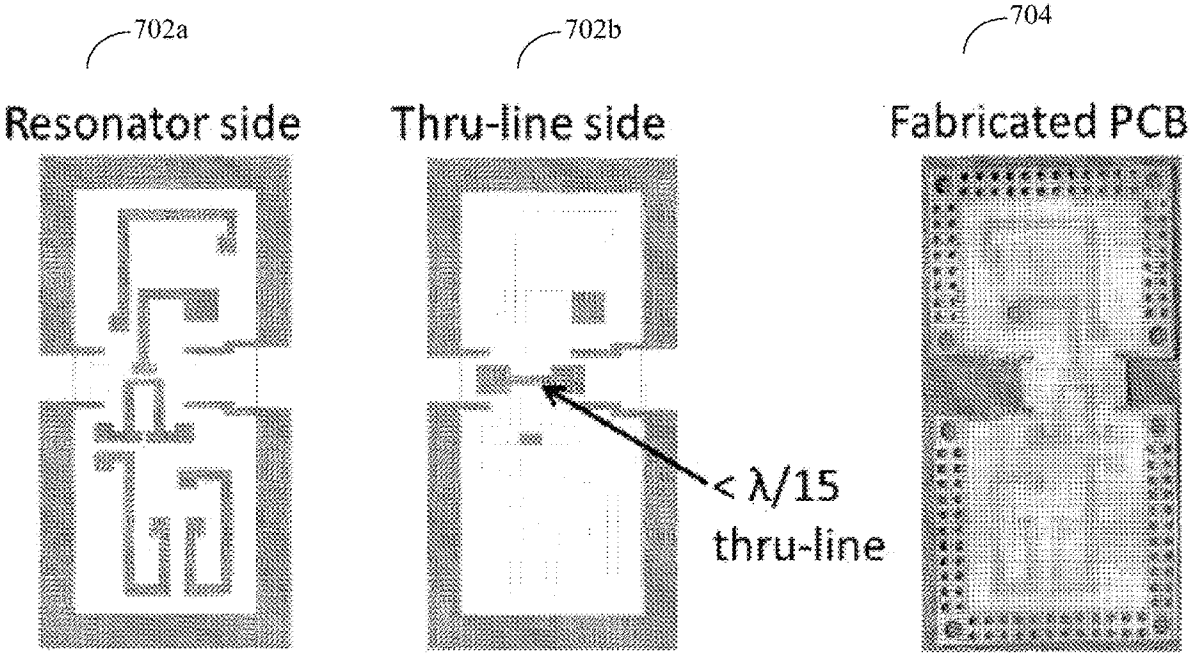
FIG. 7 is a diagram showing models and a photograph of a fabricated circuit board in accordance with an embodiment of the present disclosure.
Figure 8:
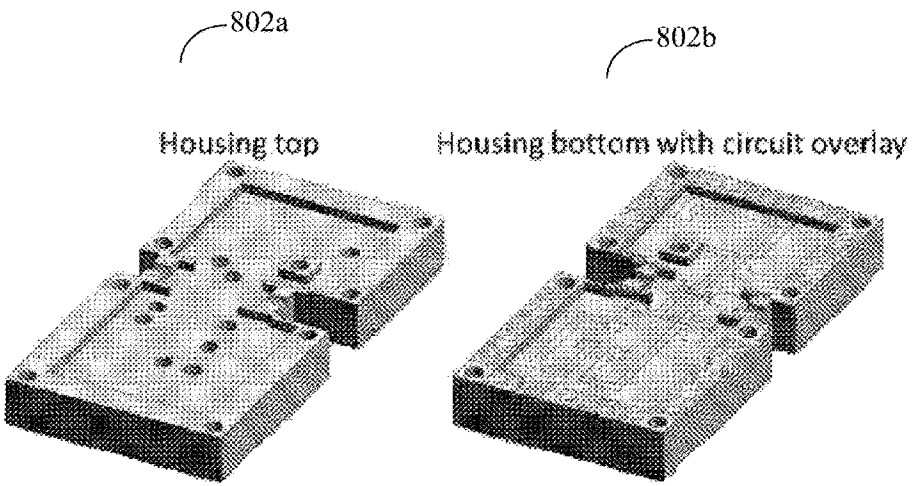
FIG. 8 is a diagram showing models of exemplary housing in accordance with an embodiment of the present disclosure.

FIG. 7 is a diagram showing models 702 and a photograph 704 of a fabricated circuit board in accordance with an embodiment of the present disclosure. In an embodiment, the center frequency of the filter is 3 GHz, and it uses a $5^{th}$-order 30-dB equi-ripple elliptic response for high selectivity. The circuit board fits between two sides of a metal housing to produce a suspended stripline circuit. FIG. 8 is a diagram showing models 802 of the housing. This embodiment of the present disclosure allows this filter to have a through line length that is less than one fifteenth of a wavelength while producing a 5th-order bandstop response. A conventional 5th-order bandstop filter would require a through line length of one wavelength. This significant difference allows a filter designed in accordance with an embodiment of the present disclosure to have a substantially reduced physical size relative to conventional designs. It also enables the design of bandstop filters with extremely low passband insertion loss. For example, a filter designed in accordance with an embodiment of the present disclosure has less than 0.1 dB passband insertion loss across S band away from its 30 dB equi-ripple notch.

8. Short-Through-Line Bandstop Filters Using Dual-Coupled Resonators

Embodiments of the present disclosure include an approach using dual-coupled-resonator bandstop sections to realize microwave bandstop filters with arbitrarily-short through-line length. In an embodiment, this approach does not require the resonator-to-through-line couplings to be comprised of both electric and magnetic coupling, i.e. mixed coupling. A transformation from a conventional in-line bandstop filter topology to a dual-coupled-resonator bandstop filter topology is presented. A design procedure is given for both all dual-coupled-resonator designs and mixed (single-coupled and dual-coupled-resonator) designs. A 5th-order elliptic dual-coupled-resonator microstrip prototype is presented with a center frequency of 500 MHz and a through-line length of 6.35 cm, 17% the length of a conventional design.

Microwave bandstop filters are used in systems to block unwanted signals. At microwave frequencies bandstop filters are typically implemented using resonators electromagnetically coupled to a transmission line, with spacing between couplings close to a quarter-wavelength for symmetric responses. The required transmission-line lengths between resonator couplings may be fully or partially absorbed into the coupling structures used. However, for technologies where strong coupling is readily available (e.g., suspended stripline) the transmission-line length associated with the coupling structures can be made quite short, and so extra lengths of transmission line not associated with resonator coupling can be added to realize the required phase shift between resonator sections. This extra transmission-line length adds size and insertion loss.

Extra transmission-line length can be eliminated with the use of mixed coupling (both electric and magnetic). In many resonator technologies (e.g. evanescent-mode cavity, ceramic coaxial, etc.), mixed coupling cannot always be practically realized. Embodiments of the present disclosure address this issue with a more general approach, based on dual-coupled bandstop resonator sections, that does not require mixed coupling. Dual-coupled bandstop resonators are unique in that they allow for an arbitrary phase shift between adjacent cascaded sections, without the need for additional lengths of transmission line.

8.1. Single-Coupled Resonator to Dual-Coupled Resonator Circuit Transformation

Figure 9A:
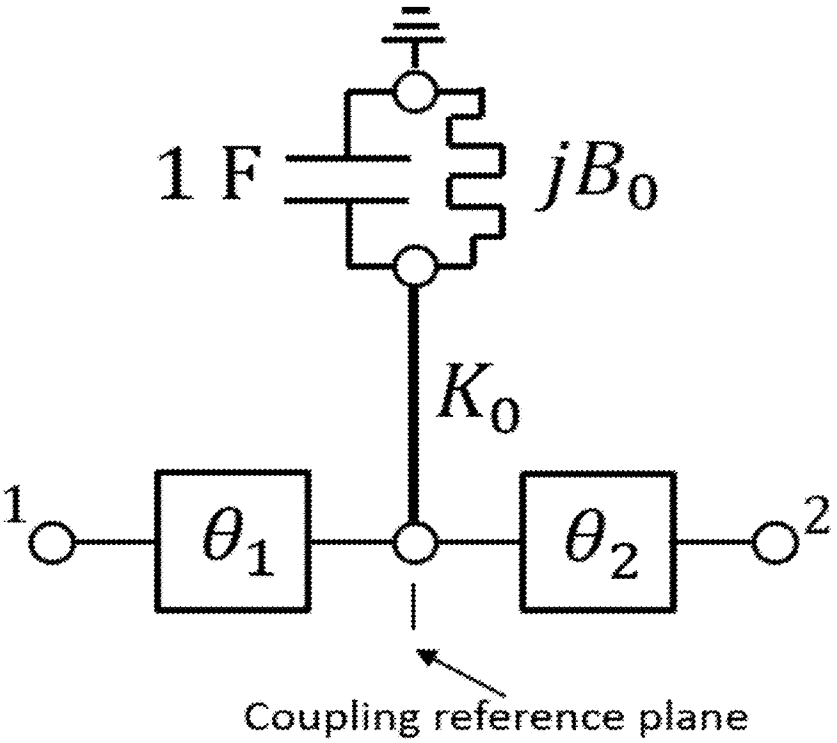
FIG. 9A is a diagram showing a normalized highpass prototype of a $1^{st}$-order bandstop section in accordance with an embodiment of the present disclosure.

FIG. 9A is a diagram showing a normalized highpass prototype of a $1^{st}$-order bandstop section in accordance with an embodiment of the present disclosure. Shown in FIG. 9A is a highpass prototype of a single-coupled-resonator bandstop section comprising a resonator, modeled as a 1 Farad capacitor in parallel with a susceptance $B_0$, coupled to a transmission line with an admittance inverter $K_0$. The point at which the resonator is coupled to the transmission line is referred to here as the coupling reference plane, defined by the electrical lengths $\theta_1$ and $\theta_2$.

Figure 9B:
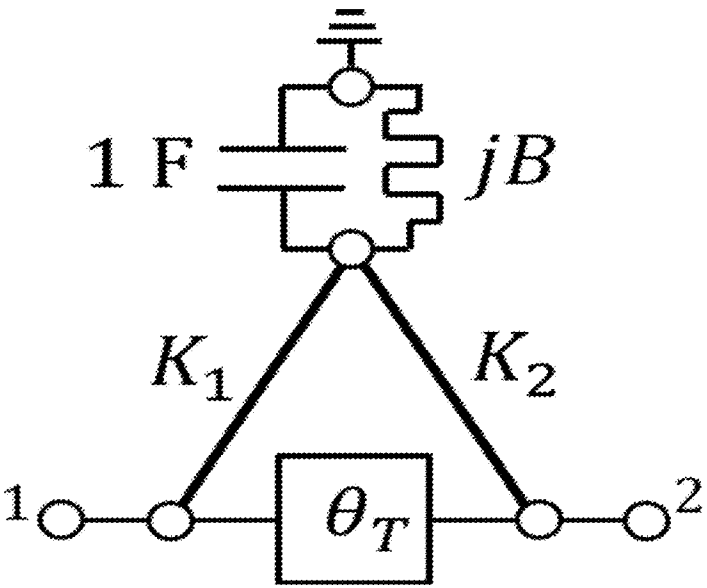
FIG. 9B is a diagram showing a dual-coupled bandstop section in accordance with an embodiment of the present disclosure.

FIG. 9B is a diagram showing a dual-coupled bandstop section in accordance with an embodiment of the present disclosure. Shown in FIG. 9B is a highpass prototype, in accordance with an embodiment of the present disclosure, of a dual-coupled-resonator bandstop section for use in bandstop filters with broad upper passbands for realizing self-switching tunable bandstop filters. The bandstop filter of FIG. 9 comprises a resonator, modeled as a 1 Farad capacitor in parallel with a susceptance B, coupled twice with admittance inverters $K_1$ and $K_2$ across a transmission line of electrical length $\theta_T$. The S-parameters for the single-coupled-resonator section are:

$$S_{21} = e^{-j(\theta_1+\theta_2)}\frac{p + jB_0}{p + \frac{K_0^2}{2} + jB_0} \tag{1}$$

$$S_{11} = e^{j(\pi-2\theta_1)}\frac{K_0^2}{2p + K_0^2 + j2B_0} \tag{2}$$

$$S_{22} = e^{j(\pi-2\theta_2)}\frac{K_0^2}{2p + K_0^2 + j2B_0}, \tag{3}$$

where p is the frequency variable jω. The single-coupled-resonator section has a transmission zero at $$\omega = -B_0. \tag{4}$$

The S-parameters of the dual-coupled-resonator section are:

$$S_{21} = \frac{j2B + 2p - j2K_1K_2\sin\theta_T}{2K_1K_2 + e^{j\theta_T}(j2B + K_1^2 + K_2^2 + 2p)} \tag{5}$$

$$S_{11} = -\frac{(e^{j\theta_T}K_1 + K_2)^2}{2e^{j\theta_T}K_1K_2 + e^{j2\theta_T}(j2B + K_1^2 + K_2^2 + 2p)} \tag{6}$$

$$S_{22} = -\frac{(K_1 + e^{j\theta_T}K_2)^2}{2e^{j\theta_T}K_1K_2 + e^{j2\theta_T}(j2B + K_1^2 + K_2^2 + 2p)}. \tag{7}$$

The single-coupled and dual-coupled sections have the same transmission-zero frequency when:

$$B = K_1K_2\sin\theta_T + B_0. \tag{8}$$

Replacing B from (8) into (5)-(7) gives:

$$S_{21} = e^{-j\theta_T}\frac{p + jB_0}{p + jB_0 + \frac{1}{2}(K_1^2 + K_2^2 + 2K_1K_2\cos\theta_T)} \tag{9}$$

$$S_{11} = -\frac{\frac{1}{2}e^{-2j\theta_T}(e^{j\theta_T}K_1 + K_2)^2}{p + jB_0 + \frac{1}{2}(K_1^2 + K_2^2 + 2K_1K_2\cos\theta_T)} \tag{10}$$

$$S_{22} = -\frac{\frac{1}{2}e^{-2j\theta_T}(e^{j\theta_T}K_2 + K_1)^2}{p + jB_0 + \frac{1}{2}(K_1^2 + K_2^2 + 2K_1K_2\cos\theta_T)}. \tag{11}$$

The single-coupled-resonator and dual-coupled-resonator sections are equivalent when:

$$K_0 = \sqrt{K_1^2 + K_2^2 + 2K_1K_2\cos\theta_T} \quad \text{and} \tag{12}$$

$$\theta_1 = \frac{1}{2}\left(\pi + j\ln\left(-\frac{K_1/K_2 + e^{-j\theta_T}}{K_1/K_2 + e^{j\theta_T}}\right)\right) \tag{13}$$

$$\theta_2 = \theta_T - \theta_1. \tag{14}$$

Simultaneously solving (12) and (13) for $K_1$ and $K_2$ gives:

$$K_1 = K_0\sin\theta_1(\cot\theta_T - \cot\theta_1) \tag{15}$$

$$K_2 = -K_0\csc\theta_T\sin\theta_1. \tag{16}$$

Equations (8), (15), and (16) can be used to transform a single-coupled-resonator section into an equivalent dual-coupled-resonator section. These equations can be used in dual-coupled-resonator and mixed-resonator design procedures in accordance with embodiments of the present disclosure.

8.2. Dual-Coupled Resonator Bandstop Filters

Figure 10A:
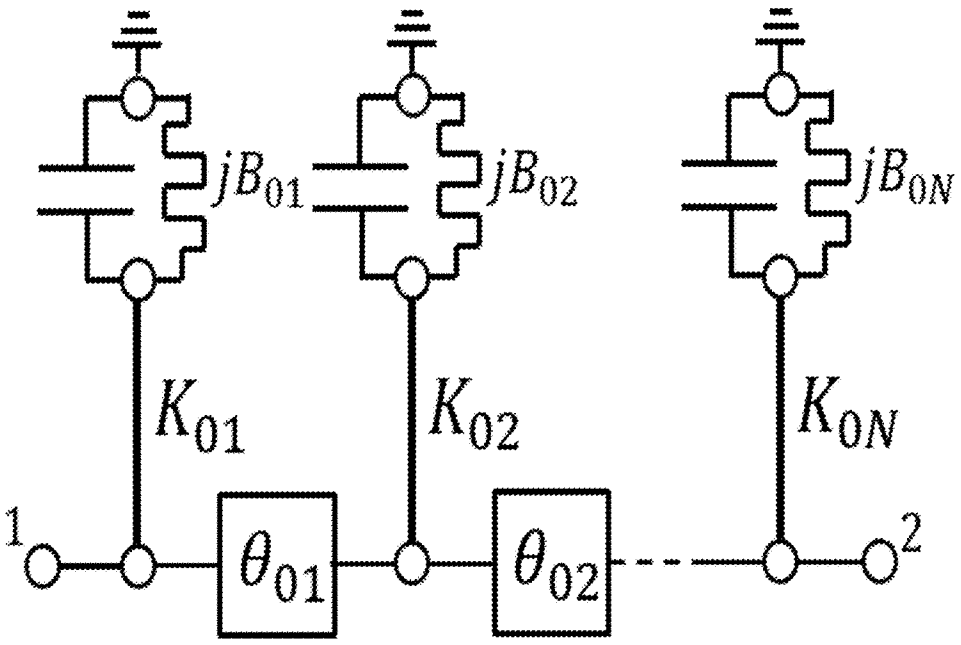
FIG. 10A is a diagram showing an in-line highpass prototype of a bandstop filter in accordance with an embodiment of the present disclosure.
Figure 10B:
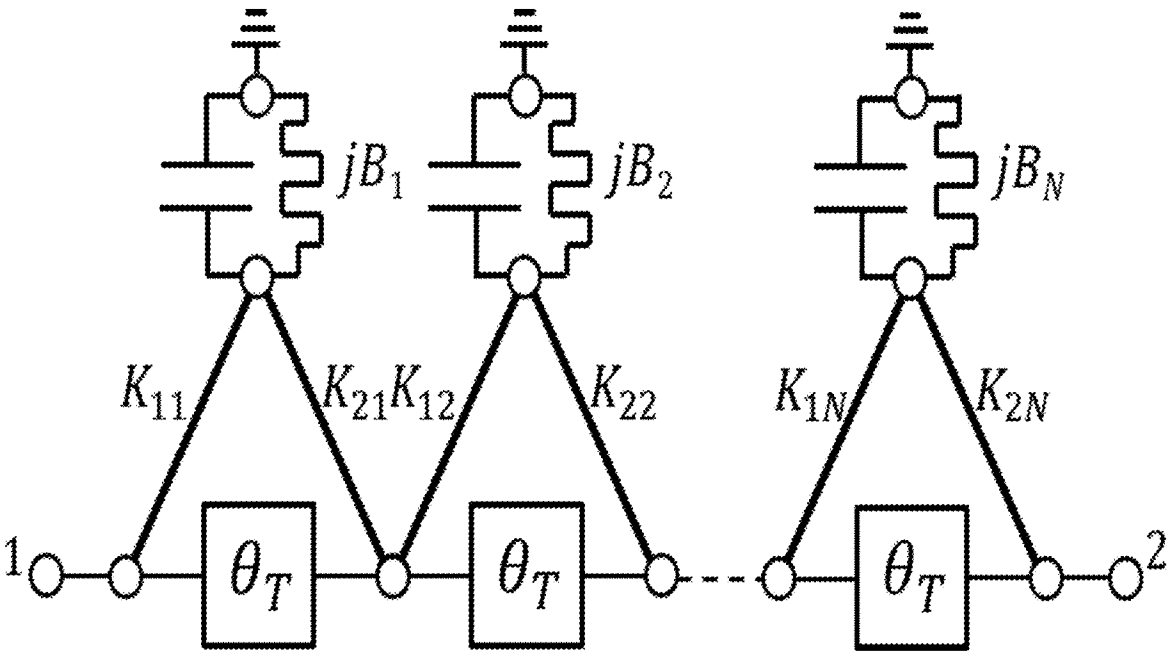
FIG. 10B is a diagram showing a dual-coupled-resonator highpass prototype in accordance with an embodiment of the present disclosure.

FIG. 10A is a diagram showing an in-line highpass prototype of a bandstop filter in accordance with an embodiment of the present disclosure. Shown in FIG. 10A is a highpass prototype comprised of single-coupled-resonator sections. FIG. 10B is a diagram showing a dual-coupled-resonator highpass prototype in accordance with an embodiment of the present disclosure. Shown in FIG. 10B is the equivalent dual-coupled-resonator prototype in accordance with an embodiment of the present disclosure. An exemplary design procedure for designing a prototype as in FIG. 10B will now be discussed.

Step 1: Synthesize a highpass prototype of the form shown in FIG. 10A that has the desired transfer function.

Step 2: Set $\theta_T$ to a desirable value. Small values of $\theta_T$ may require relatively strong coupling coefficients $K_1$ and $K_2$ from electrically-short coupling structures, which may not be possible will all circuit technologies. Finding the shortest possible value of $\theta_T$ for a given response specification may require an iterative approach.

Step 3: Determine the input phase shift $\theta_{1k}$ for each $k^{th}$ dual-coupled-resonator section in the dual-coupled-resonator prototype (FIG. 10B) by performing the following substeps.

a) If lumped-element coupling will be used in the desired circuit, with which strong coupling values can be obtained over short phase lengths, an arbitrary value between 0 and 180 degrees can be assigned to $\theta_{11}$, the input phase shift of the first dual-coupled resonator section as defined in (13). If distributed coupling will be used in the desired circuit, with which the lengths of the coupling structures will be on the same order as $\theta_T$, $\theta_{11}$ should be calculated such that the maximum required value of the magnitude of $K_1$ and $K_2$ is minimized so that the smallest value of $\theta_T$ can be used for the chosen circuit technology. In an embodiment, this calculation is best accomplished with a loop algorithm that iterates $\theta_{11}$ from 0 to 180 degrees and then does the computation in sub-steps b) and c) below for each value of $\theta_{11}$.

b) For k=2-N: $\theta_{1k}=\theta_{0(k-1)}-\theta_{2(k-1)}$, where $\theta_{0(k-1)}$ is the phase shift after the $(k-1)^{th}$ resonator in the highpass prototype synthesized in Step 1 and shown in FIG. 10A and $\theta_{2(k-1)}$ is the phase shift of the $(k-1)^{th}$ resonator that can be found using (14).

c) Given $K_{0k}$, $B_{0k}$, and $\theta_{1k}$ from the highpass prototype, calculate the dual-coupled highpass prototype values of $K_{1k}$, $K_{2k}$, and $B_k$ for a desired $\theta_T$ using (8), (15), and (16). If $\theta_{11}$ was swept to determine the minimum possible $\theta_T$ value for distributed coupling, the result will be an array of $K_{1k}$ and $K_{2k}$ values. Choose the value of $\theta_{11}$ that minimizes the maximum magnitude of $K_{1k}$ and $K_{2k}$. Then, using simulation of a dual-coupled resonator, determine if the maximum required coupling magnitude is achievable with the chosen circuit technology and value of $\theta_T$. If it is, proceed to Step 4. If it is not achievable, $\theta_T$ should be increased and Step 3 should be repeated until achievable coupling values are obtained.

Step 4: Perform a bandpass transformation to the desired center frequency and bandwidth to realize a bandstop prototype.

Step 5: Design the final filter using a desired circuit technology from the bandstop prototype. It may not be convenient to design the filter directly from the bandstop prototype, in which case each dual-coupled section can be designed using the center frequency, 3-dB bandwidth, and input phase shift $\theta_{1k}$ using the optimization or parameterization capabilities of a circuit simulator such as AWR Microwave Office. $\theta_{1k}$ can be determined from simulation using the equation:

$$\theta_{1k}=-\tfrac{1}{2}(\arg(S_{11(k)})|_{f=f0}+90) \tag{17}$$

As a demonstration of the proposed dual-coupled-resonator design procedure, a $5^{th}$-order elliptic-function microstrip prototype was designed, built, and tested. First a 5th-order elliptic highpass prototype is synthesized. Element values are (in reference to FIG. 10A): $K_{01}$=0.71315, $K_{02}$=1.21395, $K_{03}$=1.3377, $K_{04}$=1.21395, $K_{05}$=0.71315, $B_{01}$=0.96301, $B_{02}$=0.6426, $B_{03}$=0, $B_{04}$=0.6426, $B_{05}$=0.96301. $\theta_{01}$=72.13, $\theta_{02}$=84.85, $\theta_{03}$=98.16, $\theta_{04}$=107.87. The total through-line electrical length is 360°.

Next, the conventional highpass prototype is transformed into a dual-coupled-resonator prototype. An electrical length of 12.5° is chosen for the dual-coupled-resonator through-line electrical length $\theta_T$, giving a total through-line length of 62.5°. Following the design procedure, the values of $\theta_{1k}$ are 42.50 (an arbitrarily chosen value due to the planned use of lumped-element coupling), 102.13, 174.48, 80.14, and 175.51 degrees. The resulting element values are (with reference to FIG. 10B): $K_{11}$=1.6475, $K_{21}$=−2.2260, $K_{12}$=5.6086, $K_{22}$=−5.4835, $K_{13}$=1.9119, $K_{23}$=−0.5945, $K_{14}$=5.1870, $K_{24}$=−5.5259, $K_{15}$=0.9628, $K_{25}$=−0.2579, $B_1$=0.1693, $B_2$=−6.0140, $B_3$=−0.2460, $B_4$=−5.5612, $B_5$=0.9093.

The next step is to perform a standard bandpass transformation on the dual-coupled-resonator highpass prototype, which gives a bandstop prototype, and then implement the bandstop prototype using microstrip resonators. The resonators chosen for this prototype are transmission lines capacitively coupled at opposite ends to the through-line with an electrical length of $\theta_T$ between the couplings. Coupling at opposite ends of the resonator provides the required sign difference between the two couplings $K_1$ and $K_2$ in the dual-coupled-resonator sections for this design. At this point it is possible to synthesize the microstrip filter directly from the dual-coupled-resonator bandstop prototype, however the inventors have found that an approach using optimization in a circuit simulator to be much more time efficient and easily applicable to any type of resonator. This optimization is done on a section-by-section basis, where the primary optimization goals are transmission-zero frequency, 3-dB bandwidth, and input reflection-coefficient phase (related to $\theta_{1k}$ by (17)) at the transmission-zero frequency. A secondary optimization goal is the magnitude of the reflection coefficient in the passband frequencies, which should be small. This is important to ensure a well-matched passband. In the present case, as capacitive couplings are used, the impedance of the through line must be increased above 50Ω to absorb the negative capacitance required to realize the admittance inverters.

Figure 11A:
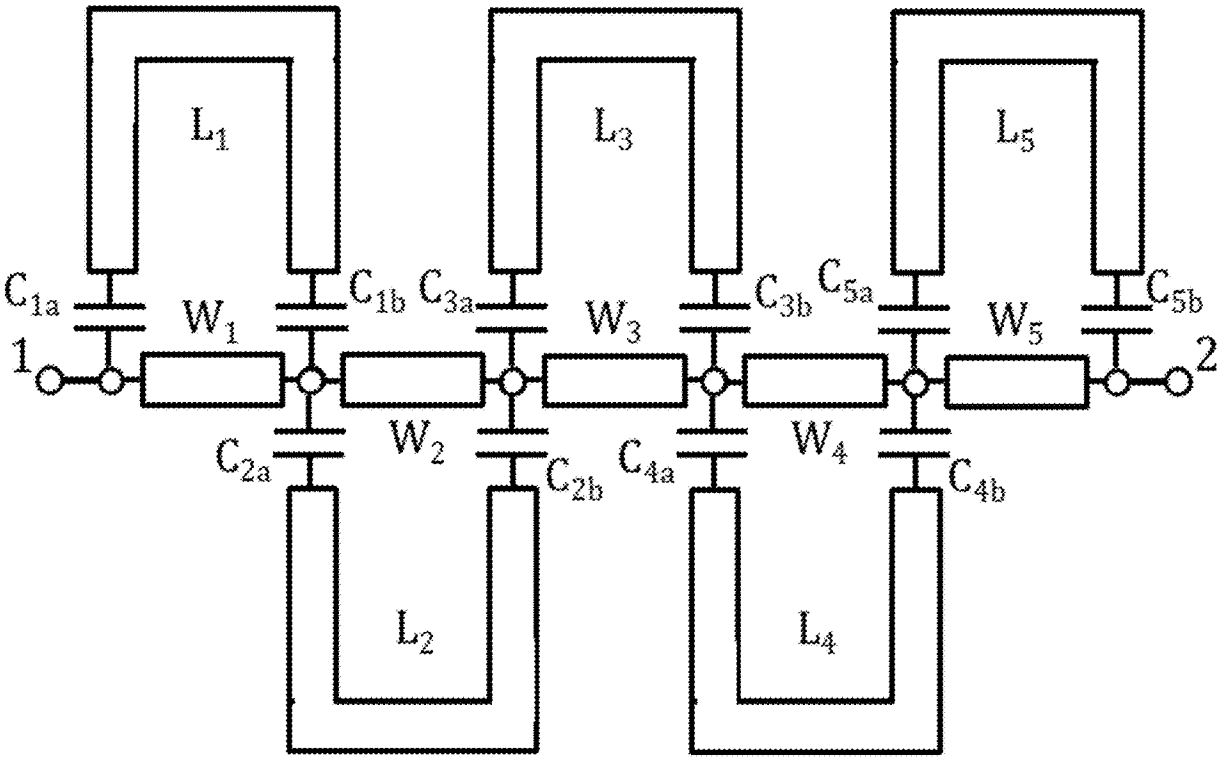
FIG. 11A is a diagram showing a schematic of a $5^{th}$-order elliptic prototype in accordance with an embodiment of the present disclosure.
Figure 11B:
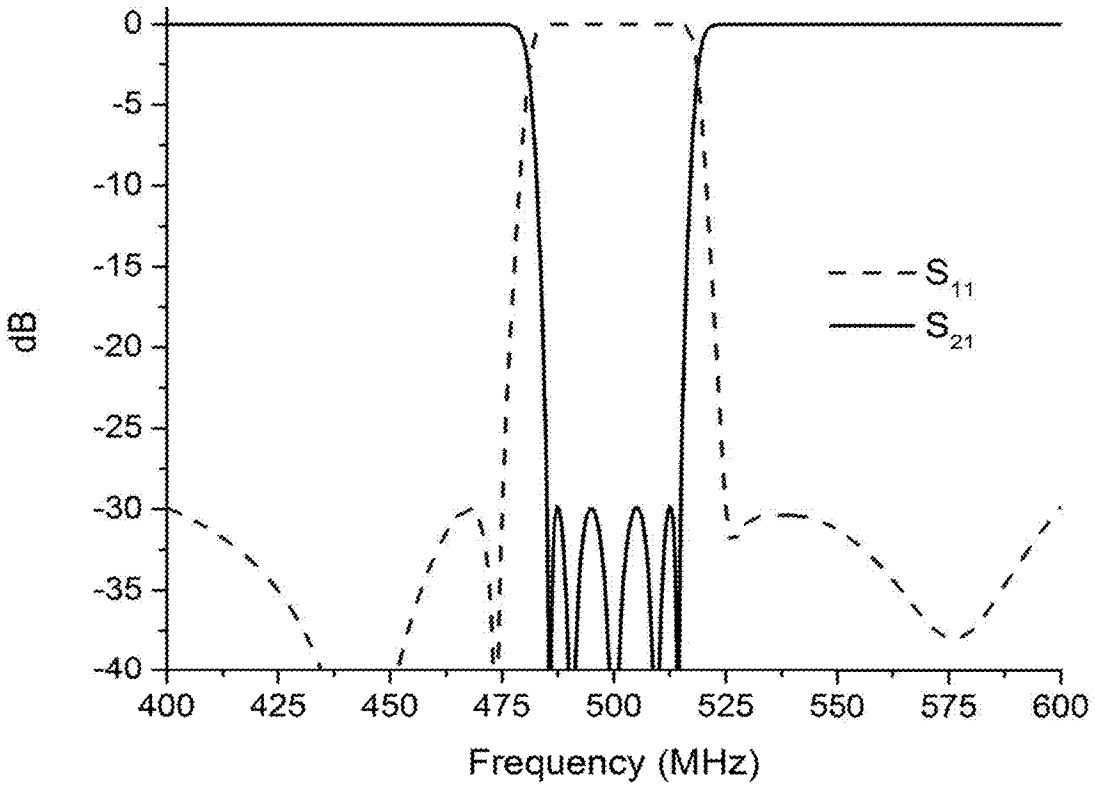
FIG. 11B is a diagram showing an AWR Microwave Office simulation of the lossless microstrip prototype in accordance with an embodiment of the present disclosure.

FIG. 11A is a diagram showing a schematic of a $5^{th}$-order elliptic prototype in accordance with an embodiment of the present disclosure. Shown in FIG. 11A is the resulting schematic-level design in AWR Microwave Office. FIG. 11B is a diagram showing an AWR Microwave Office simulation of the lossless microstrip prototype in accordance with an embodiment of the present disclosure. The substrate is Rogers 4003 (εr=3.38, tan δ=0.0027, thickness=1.524 mm).

8.3. Mixed-Resonator Bandstop Filters

When the input phase shift $\theta_{1k}$ for a given dual-coupled resonator section falls within the electrical length of the through-line phase length $\theta_T$, that is $\theta<\theta_{1k}<\theta_T$, the dual-coupled-resonator section can be realized with two couplings of the same sign, or preferably with a single-coupled bandstop resonator section (FIG. 9A) with $\theta_1=\theta_{1k}$ and $\theta_2=0$. This further decreases the total through-line length. An exemplary design procedure in accordance with an embodiment of the present disclosure will now be discussed.

Step 1: Synthesize a highpass prototype of the form shown in FIG. 10A giving the desired transfer function.

Step 2: Calculate the input phase shift $\theta_{1k}$ for each $1^{st}$-order section by following the sub-steps below. This is an iterative procedure that maximizes the number of conventional bandstop sections.

a) Choose a convenient value of $\theta_T$.

b) Assign a value to $\theta_{11}$.

c) For k=2-N: $\theta_{1k}=B_{0k-1}-\theta_{2k-1}$. For every section, if $0<\theta_{1k}<\theta_T$, a single-coupled bandstop section is used (FIG. 9A) with $\theta_1=\theta_{1k}$ and $\theta_2=0$.

d) Assess and record the total through-line length.

e) Return to b) and choose a different $\theta_{11}$. Repeat until $\theta_{11}$ has been swept from 0 to 180 degrees with acceptable resolution. Choose the value of $\theta_{11}$ that results in the minimum total through-line length.

Step 3: Given $K_{0k}$, $B_{0k}$, and $\theta_{1k}$, calculate the dual-coupled lowpass prototype values of $K_{1k}$, $K_{2k}$, and $B_k$ for a desired $\theta_T$. For the single-coupled bandstop sections: $K_0=K_{0k}$, $\theta_1=\theta_{1k}$, and $\theta_2=0$.

Step 4: Perform a bandpass transformation to the desired center frequency and bandwidth.

Step 5: Realize final filter from bandstop prototype (see step 5 in Section 8.2).

FIG. 12 is a diagram showing an exemplary implementation of the 5th-order elliptic bandstop filter using 1st-order dual-coupled-resonator bandstop sections with 14.32° through-lines and single-coupled-resonator sections in accordance with an embodiment of the present disclosure. Shown in FIG. 12 is a $5^{th}$-order mixed-resonator highpass prototype synthesized using the approach presented in Section 8.3. The total through-line length is 57.3°.

FIG. 13 is a diagram showing a schematic of the $5^{th}$-order elliptic prototype using dual-coupled resonators and single-coupled resonators in accordance with an embodiment of the present disclosure. Shown in FIG. 13 is the schematic-level design in AWR Microwave Office. This circuit was designed using the section-by-section optimization approach described in Section 8.2. The resonators for this prototype have been modified from the prototype presented in Section 8.2, in that the location of the couplings have been offset from the ends of the resonators in order to suppress coupling to the $2^{nd}$-order harmonic resonance and improve the upper passband. Due to the very short through-line lengths, the resonators are spaced very close together, and so RF shields are added in the fabricated design to prevent distortion of the response caused by unwanted inter-resonator coupling.

9. Conclusion

It is to be appreciated that the Detailed Description, and not the Abstract, is intended to be used to interpret the claims. The Abstract may set forth one or more but not all exemplary embodiments of the present disclosure as contemplated by the inventor(s), and thus, is not intended to limit the present disclosure and the appended claims in any way.

The present disclosure has been described above with the aid of functional building blocks illustrating the implementation of specified functions and relationships thereof. The boundaries of these functional building blocks have been arbitrarily defined herein for the convenience of the description. Alternate boundaries can be defined so long as the specified functions and relationships thereof are appropriately performed.

The foregoing description of the specific embodiments will so fully reveal the general nature of the disclosure that others can, by applying knowledge within the skill of the art, readily modify and/or adapt for various applications such specific embodiments, without undue experimentation, without departing from the general concept of the present disclosure. Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

Any representative signal processing functions described herein can be implemented using computer processors, computer logic, application specific integrated circuits (ASIC), digital signal processors, etc., as will be understood by those skilled in the art based on the discussion given herein. Accordingly, any processor that performs the signal processing functions described herein is within the scope and spirit of the present disclosure.

The above systems and methods may be implemented as a computer program executing on a machine, as a computer program product, or as a tangible and/or non-transitory computer-readable medium having stored instructions. For example, the functions described herein could be embodied by computer program instructions that are executed by a computer processor or any one of the hardware devices listed above. The computer program instructions cause the processor to perform the signal processing functions described herein. The computer program instructions (e.g., software) can be stored in a tangible non-transitory computer usable medium, computer program medium, or any storage medium that can be accessed by a computer or processor. Such media include a memory device such as a RAM or ROM, or other type of computer storage medium such as a computer disk or CD ROM. Accordingly, any tangible non-transitory computer storage medium having computer program code that cause a processor to perform the signal processing functions described herein are within the scope and spirit of the present disclosure.

While various embodiments of the present disclosure have been described above, it should be understood that they have been presented by way of example only, and not limitation. It will be apparent to persons skilled in the relevant art that various changes in form and detail can be made therein without departing from the spirit and scope of the disclosure. Thus, the breadth and scope of the present disclosure should not be limited by any of the above-described exemplary embodiments.

What is claimed is:

1. A filter, comprising:

a first resonator coupled to a transmission line of the filter at a first point and a second point, wherein the first point and the second point are separated by a phase length $\theta_T$ less than $\lambda/4$; and a second resonator electrically and magnetically coupled to the transmission line, via a single connection point, at the first point.

2. The filter of claim 1, wherein the second resonator is electrically and magnetically coupled to the transmission line according to a coupling ratio, wherein the coupling ratio is configured to reduce $\theta_T$ to less than $\lambda/4$.

3. The filter of claim 1, further comprising:

a third resonator coupled to the transmission line at a third point and a fourth point, wherein the third point and the fourth point are separated by a second phase length less than $\lambda/4$.

4. The filter of claim 3, further comprising:

a fourth resonator electrically and magnetically coupled to the transmission line via a second single connection point.

5. The filter of claim 1, wherein a first coupling of the first resonator to the transmission line at the first point has a first coupling strength $K_1$, and wherein a second coupling of the first resonator to the transmission line at the second point has a second coupling strength $K_2$.

6. The filter of claim 5, wherein $\theta_T$ is configured based on values of $K_1$ and $K_2$.

7. The filter of claim 5, wherein the filter is configured such that when a magnitude of $K_1$ or $K_2$ is increased, $\theta_T$ is decreased.

8. A filter, comprising:

a transmission line; and a resonator coupled to the transmission line at a first point and a second point, wherein the first point and the second point are separated by a phase length $\theta_T$ less than $\lambda/4$.

9. The filter of claim 8, wherein a first coupling of the resonator to the transmission line at the first point has a first coupling strength $K_1$, and wherein a second coupling of the resonator to the transmission line at the second point has a second coupling strength $K_2$.

10. The filter of claim 9, wherein $\theta_T$ is configured based on values of $K_1$ and $K_2$.

11. The filter of claim 9, wherein the filter is configured such that when a magnitude of $K_1$ or $K_2$ is increased, $\theta_T$ is decreased.

12. The filter of claim 8, further comprising:

a second resonator electrically and magnetically coupled to the transmission line, via a single connection point, at the first point.

13. The filter of claim 12, further comprising:

a third resonator coupled to the transmission line at a third point and a fourth point, wherein the third point and the fourth point are separated by a third phase length less than $\lambda/4$.

14. The filter of claim 13, further comprising:

a fourth resonator electrically and magnetically coupled to the transmission line via a second single connection point.

15. A filter, comprising:

a transmission line;

a first resonator coupled to the transmission line at a first point and a second point, wherein the first point and the second point are separated by a phase length $\theta_{T1}$ less than $\lambda/4$; and a second resonator coupled to the transmission line at a third point and a fourth point, wherein the third point and the fourth point are separated by a second phase length $\theta_{T2}$ less than $\lambda/4$.

16. The filter of claim 15, wherein a composite frequency response of the filter is determined based on values of $\theta_{T1}$ and $\theta_{T2}$ and respective couplings between the first resonator and the transmission line and the second resonator and the transmission line.

17. The filter of claim 15, wherein a first coupling of the first resonator to the transmission line at the first point has a first coupling strength $K_1$, and wherein a second coupling of the first resonator to the transmission line at the second point has a second coupling strength $K_2$.

18. The filter of claim 17, wherein $\theta_{T1}$ is configured based on values of $K_1$ and $K_2$.

19. The filter of claim 17, wherein the filter is configured such that when a magnitude of $K_1$ or $K_2$ is increased, $\theta_{T1}$ is decreased.

* * * * *